US010227682B2

(12) United States Patent
Takasawa et al.

(10) Patent No.: US 10,227,682 B2
(45) **Date of Patent: *Mar. 12, 2019**

(54) HIGH-STRENGTH LOW-ALLOY STEEL EXCELLENT IN HIGH-PRESSURE HYDROGEN ENVIRONMENT EMBRITTLEMENT RESISTANCE CHARACTERISTICS AND METHOD FOR PRODUCING THE SAME

(71) Applicant: THE JAPAN STEEL WORKS, LTD., Tokyo (JP)

(72) Inventors: Kouichi Takasawa, Muroran (JP); Yoru Wada, Muroran (JP); Ryoji Ishigaki, Muroran (JP); Yasuhiko Tanaka, Tokyo (JP)

(73) Assignee: THE JAPAN STEEL WORKS, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/616,064

(22) Filed: Feb. 6, 2015

(65) Prior Publication Data

US 2015/0152532 A1 Jun. 4, 2015

Related U.S. Application Data

(62) Division of application No. 12/991,981, filed as application No. PCT/JP2009/058933 on May 13, 2009, now Pat. No. 8,974,612.

(30) Foreign Application Priority Data

May 13, 2008 (JP) ..... 2008-125838

(51) Int. Cl.
*C22C 38/42* (2006.01)
*C22C 38/02* (2006.01)
(Continued)

(52) U.S. Cl.
CPC ..... *C22C 38/54* (2013.01); *C21D 1/18* (2013.01); *C21D 1/28* (2013.01); *C21D 6/004* (2013.01);
(Continued)

(58) Field of Classification Search
CPC ..... C21D 9/0081; C21D 1/18; C21D 6/004; C21D 6/005; C21D 6/008
See application file for complete search history.

(56) References Cited

U.S. PATENT DOCUMENTS 4,001,052 A 1/1977 Najazato et al.
8,313,589 B2 * 11/2012 Takasawa ..... C21D 1/28 148/330
(Continued)

FOREIGN PATENT DOCUMENTS

EP 1 905 850 A1 4/2008
EP 2 180 074 A1 4/2010
(Continued)

OTHER PUBLICATIONS

International Search Report, dated Aug. 18, 2009, issued in Application No. PCT/JP2009/058933.
(Continued)

*Primary Examiner* — Daniel McCracken
(74) *Attorney, Agent, or Firm* — Sughrue Mion, PLLC

(57) ABSTRACT

An object of the present invention is to provide at a low cost a low-alloy steel having a high strength and excellent high-pressure hydrogen environment embrittlement resistance characteristics under a high-pressure hydrogen environment. The invention is a high-strength low-alloy steel having high-pressure hydrogen environment embrittlement resistance characteristics, which has a composition comprising C: 0.10 to 0.20% by mass, Si: 0.10 to 0.40% by mass, Mn: 0.50 to 1.20% by mass, Ni: 0.75 to 1.75% by mass, Cr:
(Continued)

0.20 to 0.80% by mass, Cu: 0.10 to 0.50% by mass, Mo: 0.10 to 1.00% by mass, V: 0.01 to 0.10% by mass, B: 0.0005 to 0.005% by mass and N: 0.01% by mass or less, and further comprising one or two of Nb: 0.01 to 0.10% by mass and Ti: 0.005 to 0.050% by mass, with the balance consisting of Fe and unavoidable impurities.

12 Claims, 5 Drawing Sheets

(51) Int. Cl.

| | |
|---|---|
| ***C22C 38/54*** | (2006.01) |
| ***C21D 1/28*** | (2006.01) |
| ***C21D 8/02*** | (2006.01) |
| ***C22C 38/04*** | (2006.01) |
| ***C22C 38/44*** | (2006.01) |
| ***C22C 38/46*** | (2006.01) |
| ***C21D 1/18*** | (2006.01) |
| ***C21D 6/00*** | (2006.01) |
| ***C21D 9/00*** | (2006.01) |
| ***C22C 38/00*** | (2006.01) |
| ***C22C 38/48*** | (2006.01) |
| ***C22C 38/50*** | (2006.01) |

(52) U.S. Cl.
CPC ..... *C21D 6/005* (2013.01); *C21D 6/008* (2013.01); *C21D 8/02* (2013.01); *C21D 9/0081* (2013.01); *C22C 38/001* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/005* (2013.01)

(56) References Cited

U.S. PATENT DOCUMENTS

| | | | | |
|---|---|---|---|---|
| 2003/0047256 | A1 | 3/2003 | Kami et al. | |
| 2005/0000601 | A1 | 1/2005 | Arai et al. | |
| 2005/0199322 | A1 | 9/2005 | Nakamura et al. | |
| 2005/0217768 | A1 | 10/2005 | Asahi et al. | |
| 2006/0144474 | A1 | 7/2006 | Yamasaki et al. | |
| 2007/0068607 | A1 * | 3/2007 | Huff | 148/663 |
| 2007/0144633 | A1 | 6/2007 | Kizu et al. | |
| 2009/0285713 | A1 | 11/2009 | Omura et al. | |

FOREIGN PATENT DOCUMENTS

| | | | | |
|---|---|---|---|---|
| JP | 2-213411 | A | | 8/1990 |
| JP | 5-051694 | A | | 3/1993 |
| JP | 11-315339 | A | | 11/1999 |
| JP | 2000-129392 | A | | 5/2000 |
| JP | 2001-123245 | A | | 5/2001 |
| JP | 2001-234242 | A | | 8/2001 |
| JP | 2001-288512 | A | | 10/2001 |
| JP | 2002-327235 | A | | 11/2002 |
| JP | 2005-002386 | A | | 1/2005 |
| JP | 2006206942 | A | * | 8/2006 |
| JP | 2007-063608 | A | | 3/2007 |
| JP | 2009-046737 | A | | 3/2009 |
| JP | 2009-074122 | A | | 4/2009 |

OTHER PUBLICATIONS

Written Opinion, dated Aug. 18, 2009, issued in Application No. PCT/JP2009/058933.
"Standard Specification for High-Yield-Strength, Quenched, and Tempered Alloy Steel Plate, Suitable for Welding", ASTM Designation: A514/A514M-05, Sep. 12, 2005, pp. 1-3.
"ISG Plate A514 &'T-1'", ISG Plate, Jul. 20, 2004, pp. 1-27.
Search Report dated Jun. 2, 2014, issued by the European Patent Office in counterpart European Application No. 09746626.2.
Machine translation of JP 2007063608, dated Mar. 15, 2007, JFE Steel KK, 11 pages.

* cited by examiner

HIGH-STRENGTH LOW-ALLOY STEEL EXCELLENT IN HIGH-PRESSURE HYDROGEN ENVIRONMENT EMBRITTLEMENT RESISTANCE CHARACTERISTICS AND METHOD FOR PRODUCING THE SAME

CROSS REFERENCE TO RELATED APPLICATIONS

This application is divisional of application Ser. No. 12/991,981 filed on Nov. 10, 2010, which is a National Stage of International Application No. PCT/JP2009/058933 filed on May 13, 2009, which claims priority from Japanese Patent Application No. 2008-125838, filed on May 13, 2008, the contents of all of which are incorporated herein by reference in their entirety.

TECHNICAL FIELD

The present invention relates to a high-strength low-alloy steel, which is used for a pressure vessel for storing high-pressure hydrogen and the like, and which is produced by a quenching-tempering treatment (hereinafter referred to as heat treatment), and a method for producing the same.

BACKGROUND ART

In a hydrogen infrastructure improvement business for building a hydrogen society, it is important to spread hydrogen stations for storing and supplying high-pressure hydrogen. In order to configure the hydrogen stations having high reliability, development of high-pressure hydrogen gas pressure vessels is indispensable, and development of excellent materials for the pressure vessels has been desired. Here, metal materials, particularly steel materials, show promise as the materials for the pressure vessels, from the viewpoints of cost and recyclability.

As a technical trend, it has been desired that pressure of stored gas is made higher in order to extend a travel distance of hydrogen cars, and it has been envisioned that the high-pressure hydrogen gas of 35 MPa or more is stored in the pressure vessels of the hydrogen stations. However, in conventional carbon steels or high-strength low-alloy steels, it has been conceivable that hydrogen environment embrittlement occurs under a high-pressure hydrogen gas environment. Thus, a steel material, which can be used under a high-pressure hydrogen gas environment of 35 MPa or more, has been almost limited to an austenitic stainless steel until now. The austenitic stainless steel is generally more expensive than a low-alloy steel. Further, the austenitic stainless steel has a stable austenite phase up to room temperature, so that strength adjustment by heat treatment cannot be performed. Accordingly, a high-strength low-alloy steel has been desired as the material for the pressure vessels for storing the higher-pressure hydrogen gas.

In order to meet such requests, there have been proposed a carbon steel or a low-alloy steel under a high-pressure hydrogen environment, a seamless steel pipe produced therefrom, and a method for producing the same (for example, Patent Literature 1). The steel proposed in the Patent Literature 1 decreases an amount of diffusible hydrogen in the steel by controlling the Ca/S ratio of components in order to improve high-pressure hydrogen environment embrittlement resistance characteristics.

CITATION LIST

Patent Literature

Patent Literature 1: JP-A-2005-2386

SUMMARY OF THE INVENTION

Technical Problems to be Solved by the Invention

However, the above-described proposed technique is based on test data obtained by simulating a high-pressure hydrogen environment by an electrolytic hydrogen charge, that is, only indirectly evaluates hydrogen environment embrittlement resistance characteristics. Further, the above-described proposed technique shows no data with regard to mechanical properties indispensable for design or production of actual equipment, particularly mechanical properties in a state affected by hydrogen environment embrittlement.

Furthermore, from the results of conventional tensile tests in a hydrogen environment of 45 MPa for various low-alloy steels, a high yield strength steel plate for welded construction, JIS G 3128 SHY685NS, shows a large reduction of area in hydrogen and has been a material excellent in hydrogen environment embrittlement resistance characteristics. However, the tensile strength in the air thereof does not reach 900 to 950 MPa as the present target strength.

The present invention has been made in view of the above-described present situation of development of high-strength steels excellent in high-pressure hydrogen environment embrittlement resistance characteristics. By evaluating the hydrogen environment embrittlement resistance characteristics in the hydrogen environment of 45 MPa, an object of the invention is to provide a high-strength low-alloy steel having excellent hydrogen environment embrittlement resistance characteristics within the range where the tensile strength in the air is from 900 to 950 MPa, and a method for producing the same, based on the evaluation.

Means for Solving the Problems

In a configuration of the invention, by using a test material based on a steel type provided as ASME SA517F, detailed studies of tensile properties in a hydrogen atmosphere of 45 MPa have been performed. As a result, there has been found a novel alloy composition having a larger value of relative reduction of area and smaller susceptibility to hydrogen environment embrittlement in the hydrogen atmosphere of 45 MPa than a conventional steel, within the tensile strength range in the air of 900 MPa to 950 MPa as the target strength range, thus leading to the invention.

That is to say, the invention relates to a high-strength low-alloy steel having high-pressure hydrogen environment embrittlement resistance characteristics and a method for producing the same, which are shown below.

[1] A high-strength low-alloy steel having high-pressure hydrogen environment embrittlement resistance characteristics, which has a composition comprising C: 0.10 to 0.20% by mass, Si: 0.10 to 0.40% by mass, Mn: 0.50 to 1.20% by mass, Ni: 0.75 to 1.75% by mass, Cr: 0.20 to 0.80% by mass, Cu: 0.10 to 0.50% by mass, Mo: 0.10 to 1.00% by mass, V: 0.01 to 0.10% by mass, B: 0.0005 to 0.005% by mass and N: 0.01% by mass or less, and further comprising one or two of Nb: 0.01 to 0.10% by mass and Ti: 0.005 to 0.050% by mass, with the balance consisting of Fe and unavoidable impurities.

[2] The high-strength low-alloy steel having high-pressure hydrogen environment embrittlement resistance characteristics according to [1], wherein the tensile strength in the air after heat treatment is from 900 MPa to 950 MPa.

[3] The high-strength low-alloy steel having high-pressure hydrogen environment embrittlement resistance characteristics according to [1] or [2], wherein the crystal grain size number after heat treatment, which is measured by a comparison method based on a ferrite crystal grain size test method for steels specified in JIS G 0552, has a grain size of 8.4 or more.

[4] A method for producing a high-strength low-alloy steel having high-pressure hydrogen environment embrittlement resistance characteristics, the method comprising: melting an alloy steel material having a composition comprising C: 0.10 to 0.20% by mass, Si: 0.10 to 0.40% by mass, Mn: 0.50 to 1.20% by mass, Ni: 0.75 to 1.75% by mass, Cr: 0.20 to 0.80% by mass, Cu: 0.10 to 0.50% by mass, Mo: 0.10 to 1.00% by mass, V: 0.01 to 0.10% by mass, B: 0.0005 to 0.005% by mass and N: 0.01% by mass or less, and further comprising one or two of Nb: 0.01 to 0.10% by mass and Ti: 0.005 to 0.050% by mass, with the balance consisting of Fe and unavoidable impurities to form a steel ingot; performing normalizing at 1,000° C. to 1,100° C. after hot-working; performing quenching from the temperature range of 880° C. to 900° C.; and after the quenching, performing tempering at 560° C. to 580° C.

Advantageous Effects of the Invention

According to the invention, as a main advantage, it becomes possible to prepare a high-pressure hydrogen pressure vessel at a lower cost than an austenitic stainless steel. Further, the strength is higher than that of a conventional steel, and susceptibility to hydrogen environment embrittlement is small, so that the design pressure can be increased, or the design thickness can be thinned. Furthermore, as a subordinate advantage, the amount of hydrogen loaded can be increased by an increase in the design pressure. In addition, the production cost of the container can be deceased by a decrease in the thickness of the container.

MODE FOR CARRYING OUT THE INVENTION

Figure 1:
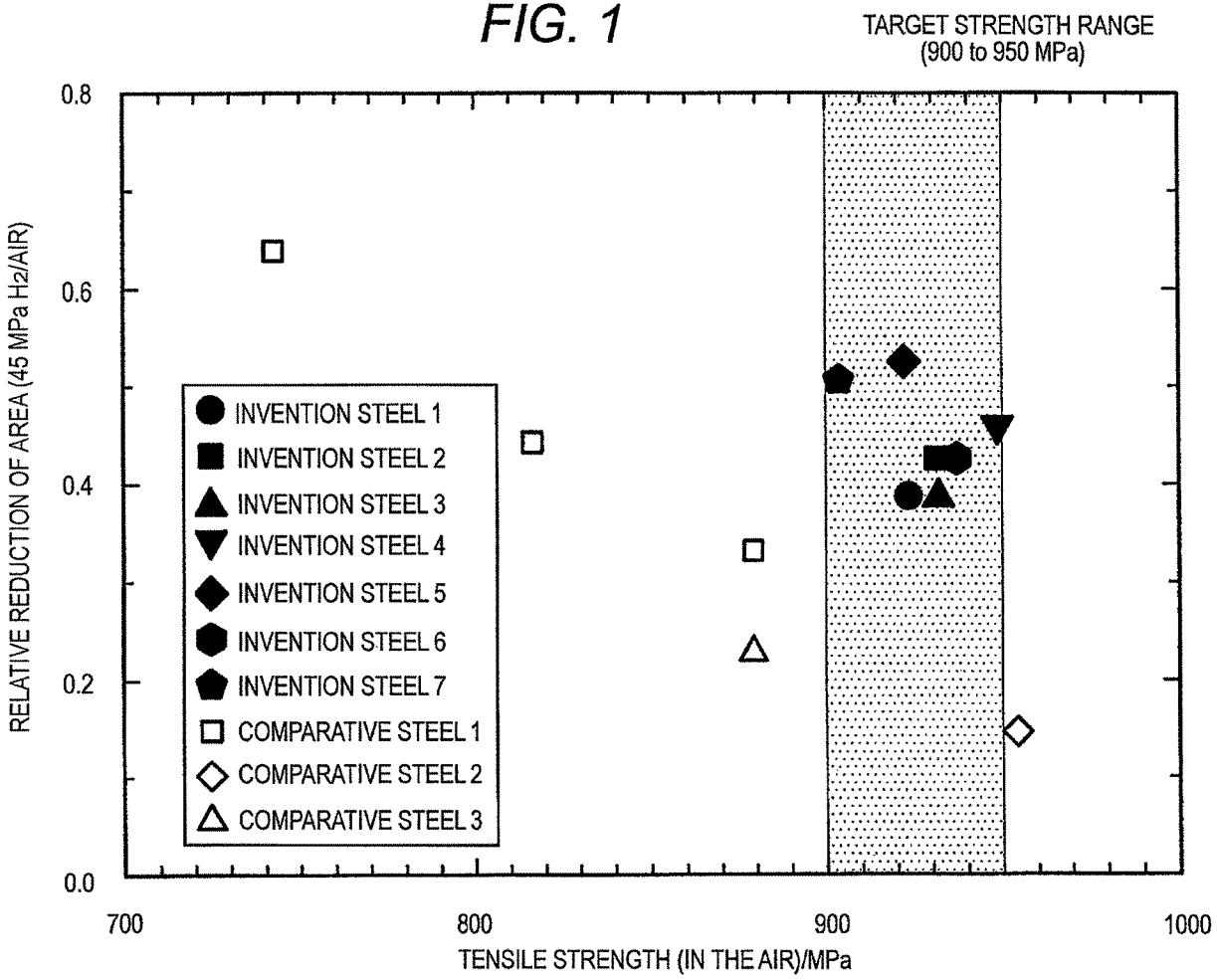
FIG. 1 is a graph showing relationship between tensile strength in the air and relative reduction of area (a ratio of reduction of area in hydrogen of 45 MPa and reduction of area in the air) of invention steels and comparative steels in Examples.

The limited ranges of the components and the like in the invention will be described below in detail. The following component contents are all represented by mass percentage.

C (Carbon): 0.10 to 0.20%

C is a component effective for improving the strength of the steel, and in order to secure the strength as a steel for welding, the lower limit value thereof is decided to be 0.10%. The excessive inclusion thereof extremely deteriorates weldability of the steel, so that the upper limit value thereof is taken as 0.20%. Preferably, the lower limit is 0.14%, and the upper limit is 0.16%.

Si (Silicon): 0.10 to 0.40%

Si is a component necessary for securing the strength of a base material, deoxidation and the like, and in order to obtain the effects thereof, the lower limit value thereof is taken as 0.10%. However, the excessive inclusion thereof causes a decrease in toughness of a welded part, so that the upper limit value thereof is taken as 0.40%. Preferably, the lower limit is 0.18%, and the upper limit is 0.32%.

Mn (Manganese): 0.50 to 1.20%

Mn is a component effective for strengthening of the steel, and the lower limit value thereof is decided to be 0.50%. However, the excessive inclusion thereof causes a decrease in toughness or a crack of a welded part, so that the upper limit value thereof is taken as 1.20%. Preferably, the lower limit is 0.80%, and the upper limit is 0.84%.

Cr (Chromium): 0.20 to 0.80%

Cr improves the strength of the steel, but the excessive inclusion thereof deteriorates weldability. Accordingly, the lower limit value thereof is taken as 0.200%, and the upper limit value thereof is taken as 0.80%. Preferably, the lower limit is 0.47%, and the upper limit is 0.57%.

Ni (Nickel): 0.75 to 1.75%

Ni is an element effective for improving the strength and hardenability of the steel, but too much Ni causes deterioration of hydrogen environment embrittlement resistance characteristics. Accordingly, the lower limit value thereof is taken as 0.75%, and the upper limit value thereof is taken as 1.75% herein. Preferably, the lower limit is 0.70%, and the upper limit is 1.55%.

Cu (Copper): 0.10 to 0.50%

Cu improves the strength of the steel, but the excessive inclusion thereof increases crack susceptibility at the time of welding. Accordingly, the lower limit value thereof is taken as 0.10%, and the upper limit value thereof is taken as 0.50%. Preferably, the lower limit is 0.20%, and the upper limit is 0.40%. More preferably, the lower limit is 0.31%, and the upper limit is 0.33%.

Mo (Molybdenum): 0.10 to 1.00%

Mo is an element effective for strengthening of the steel, but the excessive inclusion thereof deteriorates weldability, and causes an increase in cost. Accordingly, the lower limit value thereof is taken as 0.10%, and the upper limit value thereof is taken as 1.00%. Preferably, the lower limit is 0.45%, and the upper limit is 0.55%.

V (Vanadium): 0.01 to 0.10%

V is an element important to secure the strength of the steel, but too much has an adverse effect on toughness. Accordingly, the lower limit value thereof is taken as 0.01%, and the upper limit value thereof is taken as 0.10%. Preferably, the lower limit is 0.04%, and the upper limit is 0.06%.

B (Boron): 0.0005 to 0.005%

B is an element effective for strengthening of the steel and also effective for improvement of hardenability, so that the lower limit value thereof is taken as 0.0005%. On the other hand, the excessive inclusion thereof causes a reduction in weldability, so that the upper limit value thereof is taken as 0.005%. Preferably, the upper limit is 0.002%.

N (Nitrogen): 0.01% or Less

When N exceeds 0.01%, solid solution N increases to cause a decrease in toughness of a welded part. Accordingly, the upper limit value thereof is taken as 0.01%.

Nb (Niobium): 0.01 to 0.10%

Ti (Titanium): 0.005 to 0.050%

Nb and Ti are elements effective for grain refining of the steel, so that one or two thereof are allowed to be contained. However, less than 0.01% of Nb or less than 0.005% of Ti results in a failure to obtain the sufficient function. Accordingly, the lower limit value of Nb is decided to be 0.01%, and the lower limit value of Ti is decided to be 0.005%. Incidentally, when one component is contained in an amount of the lower limit or more, the other component may be contained as an impurity in an amount of less than the lower limit. On the other hand, the excessive inclusion of Nb results in saturation of the effect, and moreover, causes a reduction in weldability, so that the upper limit value thereof is decided to be 0.10%. Further, the excessive inclusion of Ti causes a decrease in toughness due to excessive deposition of TiC, so that the upper limit value thereof is decided to be 0.05%. Preferably, the lower limit of Nb is 0.02% and the upper limit thereof is 0.06%, and the lower limit of Ti is 0.01% and the upper limit thereof is 0.04%.

Balance: Fe and Unavoidable Impurities

In the high-strength low-alloy steel of the invention, the balance consists of Fe and unavoidable impurities. The unavoidable impurities include P and S.

P (Phosphorus): 0.005% or Less

In terms of preventing deterioration in hot-workability, it is preferable that the content of P is as small as possible. Taking industrial efficiency into account, the upper limit value thereof is taken as 0.005%.

S (Sulfur): 0.002% or Less

In terms of preventing deterioration in hot-workability and a decrease in toughness, it is preferable that the content of S is as small as possible. Taking industrial efficiency into account, the upper limit value thereof is taken as 0.002%.

Crystal Grain Size Number: 8.4 or more

The crystal grain size number was measured by a comparison method based on a ferrite crystal grain size test method for steels specified in JIS G 0552. The grain size after heat treatment is preferably 8.4 or more. The hydrogen environment embrittlement resistance characteristics excellent compared to those of conventional steels can be exhibited by adjusting the grain size to 8.4 or more. In the case of less than 8.4, the grain size is equal to or smaller than that of conventional steels, and improvement of the hydrogen environment embrittlement resistance characteristics cannot be expected.

Tensile Strength: 900 to 950 MPa

As a target strength, the tensile strength in the air after heat treatment is taken as 900 MPa or more. However, exceeding 950 MPa results in an increase insusceptibility to hydrogen environment embrittlement, so that the upper limit is taken as 950 MPa. Incidentally, this tensile strength is the strength at room temperature.

As heat treatment conditions to the alloy steel having the above-described composition, the following conditions are shown.

Normalizing Temperature: 1,000° C. to 1,100° C.

In order to remove strain at the time of forging, the normalizing temperature is decided to be 1,000° C. to 1,100° C.

Quenching Temperature: 880 to 900° C.

In order to impart the optimum crystal grain size, the quenching temperature is decided to be 880 to 900° C.

Tempering Temperature: 560° C. to 580° C.

In order to impart the optimum tensile strength at room temperature in the air, the tempering temperature is decided to be 560° C. to 580° C.

One embodiment of the invention will be described below.

Alloy steel raw materials adjusted to the composition of the invention are melted to obtain an ingot. A method for melting the alloy steel raw materials is not particularly limited as the invention, and the ingot can be obtained by a conventional method.

The ingot can be subjected to hot-working (hot rolling, hot forging or the like) by a conventional method, and conditions and the like in the hot-working are not particularly limited as the invention.

After the hot-working, suitably, normalizing is performed to a hot-worked material to homogenize a structure. The normalizing can be performed, for example, by heating at 1,100° C. for two hours, followed by furnace cooling.

Further, a quenching-tempering treatment can be performed as heat treatment.

Quenching can be performed by heating, for example, to 880 to 900° C. and rapid cooling. After the quenching, tempering in which heating is performed can be performed at 560 to 580° C., for example. In the tempering, it is preferable to adjust the tempering parameter represented by $T(\log t+20)\times10^{-3}$ for the tempering temperature T (K) and time t (hr.) within the range of 18.0 to 18.5.

In the invention steel, the tensile strength in the air can be set to 900 to 950 MPa, and the crystal grain size can be adjusted to a grain size number of 8.4 or more in the comparison method of JIS G 0552 (the ferrite crystal grain size test method for steels), by heat treatment. The low-alloy high-strength steel shows an excellent reduction of area and excellent elongation characteristics even in a hydrogen atmosphere of 45 MPa.

EXAMPLES

Examples of the invention will be described in detail below.

A material under test having a composition (the balance was the other unavoidable impurities) shown in Table 1 was melted in a vacuum induction melting furnace to prepare a 50 kg round steel ingot, the thickness of which was adjusted to 35 mm by hot forging. In this test, heat treatment was performed at a thickness of 35 mm after hot forging as a production method. Incidentally, the Ti amount in example Nos. 1 and 2 and the Nb amount in example Nos. 3 and 4 are less than the analytical lower limit (Ti<0.0005%, Nb<0.01%).

The normalizing temperature in invention steels 1 to 7 was 950° C., the quenching temperature was from 880° C. to 900° C., and the tempering was performed at 580° C. The tempering temperature T (K) and time t (h) were adjusted, and the tempering parameter represented by $T(\log t+20)\times10^{-3}$ was varied within the range of 17.3 to 18.7, thereby adjusting the tensile strength in the air to the range of 900 to 950 MPa.

The quenching temperature in comparative steel 1 was 920° C., and tempering was performed at 600° C. Incidentally, the tempering time was adjusted as 11 hours and 50 minutes, 34 hours, and 97 hours and 30 minutes.

The normalizing temperature in comparative steel 2 was 1,200° C., and the quenching temperature was 950° C. Tempering was performed at 660° C. for 6 hours.

The normalizing temperature in comparative steel 3 was 900° C., and the quenching temperature was 840° C. Tempering was performed at 600° C. for 35 hours.

TABLE 1

| Material Under Test No. | | Low-Alloy Steel Composition (mass %) | | | | | | | | |
|---|---|---|---|---|---|---|---|---|---|---|
| | | C | Si | Mn | P | S | Cr | Mo | Ni | V |
| Invention Steel | 1 | 0.15 | 0.26 | 0.84 | <0.003 | 0.002 | 0.53 | 0.52 | 0.75 | 0.05 |
| | 2 | 0.14 | 0.25 | 0.84 | <0.003 | 0.002 | 0.53 | 0.52 | 0.76 | 0.05 |
| | 3 | 0.14 | 0.25 | 0.84 | <0.003 | 0.002 | 0.53 | 0.52 | 0.76 | 0.05 |
| | 4 | 0.15 | 0.25 | 0.84 | <0.003 | 0.001 | 0.53 | 0.52 | 0.76 | 0.05 |
| | 5 | 0.15 | 0.24 | 0.85 | <0.003 | 0.002 | 0.53 | 0.53 | 0.75 | 0.05 |
| | 6 | 0.16 | 0.24 | 0.83 | <0.003 | 0.002 | 0.53 | 0.51 | 1.02 | 0.05 |
| | 7 | 0.15 | 0.25 | 0.84 | <0.003 | 0.002 | 0.53 | 0.52 | 1.52 | 0.05 |
| Comparative Steel | 1 | 0.15 | 0.23 | 0.97 | 0.006 | <0.001 | 0.50 | 0.51 | 1.45 | 0.04 |
| | 2 | 0.13 | 0.04 | 0.56 | 0.006 | 0.003 | 2.47 | 1.08 | 0.17 | 0.29 |
| | 3 | 0.24 | 0.26 | 0.41 | 0.01 | 0.007 | 1.78 | 0.40 | 3.69 | 0.13 |

| Material Under Test No. | | Low-Alloy Steel Composition (mass %) | | | | | | | Remarks |
|---|---|---|---|---|---|---|---|---|---|
| | | B | Cu | Nb | N | Ti | Al | Fe | (Alloy Name) |
| Invention Steel | 1 | 0.0011 | 0.31 | 0.031 | 0.0072 | — | — | bal. | |
| | 2 | 0.0011 | 0.31 | 0.054 | 0.0072 | — | — | bal. | |
| | 3 | 0.0011 | 0.32 | — | 0.0074 | 0.012 | — | bal. | |
| | 4 | 0.001 | 0.32 | — | 0.0076 | 0.032 | — | bal. | |
| | 5 | 0.0009 | 0.32 | 0.036 | 0.0069 | 0.014 | — | bal. | |
| | 6 | 0.0011 | 0.31 | 0.029 | 0.0069 | 0.013 | — | bal. | |
| | 7 | 0.0009 | 0.31 | 0.029 | 0.0070 | 0.013 | — | bal. | |
| Comparative Steel | 1 | 0.0009 | 0.23 | — | — | — | — | bal. | SHY685NSF |
| | 2 | 0.0007 | 0.07 | 0.024 | — | 0.01 | 0.01 | bal. | F22V |
| | 3 | — | — | — | 0.008 | — | <0.005 | bal. | 3.5NiCrMoV |

After the heat treatment, the test material was processed to a smooth bar tensile test specimen specified in JIS Z 2201, No. 14. A tensile test in hydrogen was performed under a hydrogen environment of 45 MPa using a high-pressure hydrogen environment fatigue tester. The tensile test was performed under conditions of ordinary temperature and a stroke rate of 0.0015 mm/s. The crystal grain size was measured on the basis of the comparison method specified in JIS G 0552.

The relationship between the tensile strength in the air and the relative reduction of area (the ratio of reduction of area in hydrogen of 45 MPa and reduction of area in the air) of invention steels 1 to 7 and comparative steels 1 to 3 is shown in FIG. 1. The relative reduction of area of the invention steels showed a large reduction of area even when compared to the other kind of steels within 900 to 950 MPa as the target strength range. This shows that the invention steels have a higher strength than the comparative steels and are excellent in susceptibility to hydrogen environment embrittlement.

Figure 2:
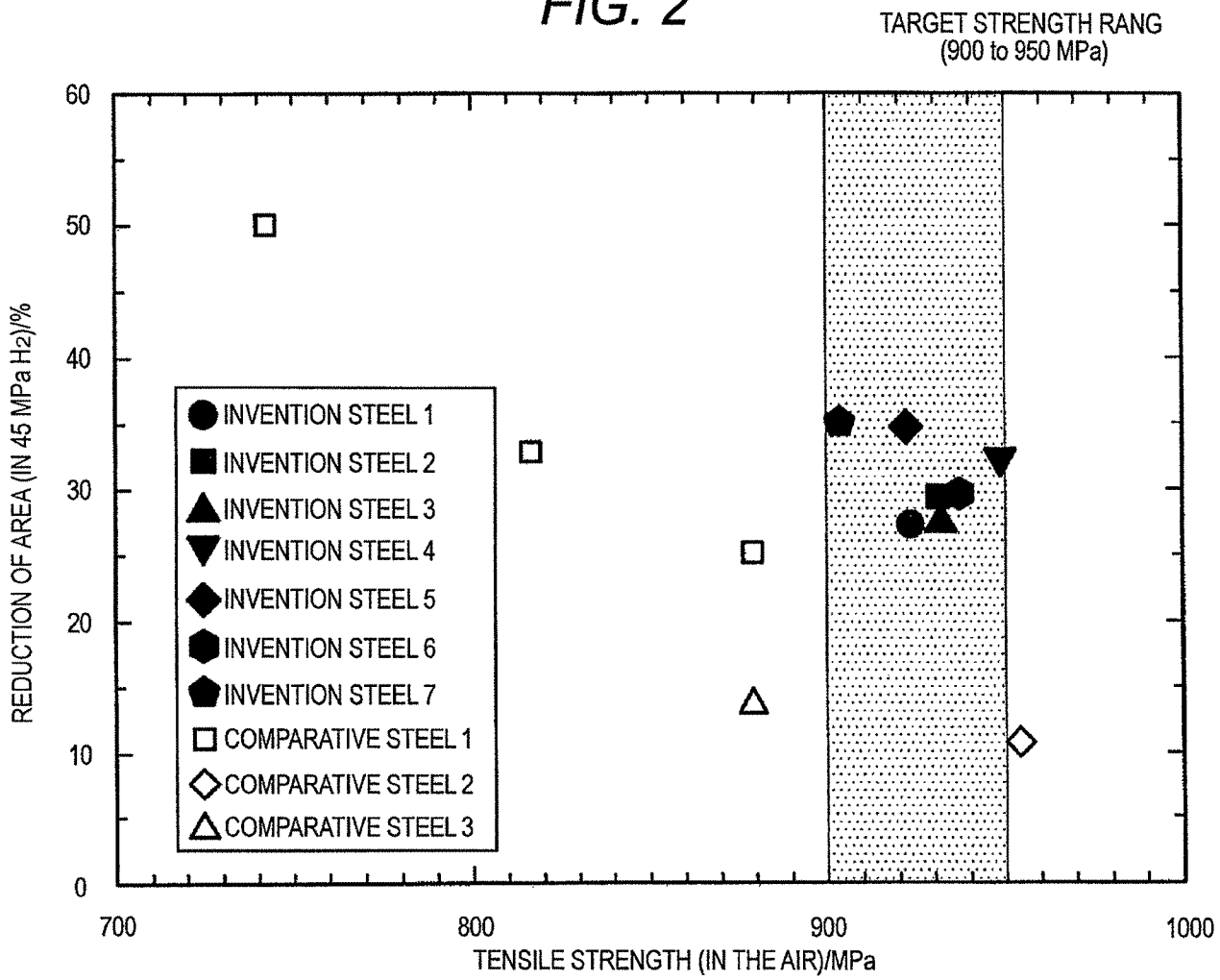
FIG. 2 is a graph showing relationship between the tensile strength in the air and reduction of area of invention steels and comparative steels in Examples.

The relationship between the tensile strength in the air and the reduction of area of invention steels 1 to 7 and comparative steels 1 to 3 is shown in FIG. 2. The invention steels showed a larger value than the conventional steels, also in the absolute value of the reduction of area.

Figure 3:
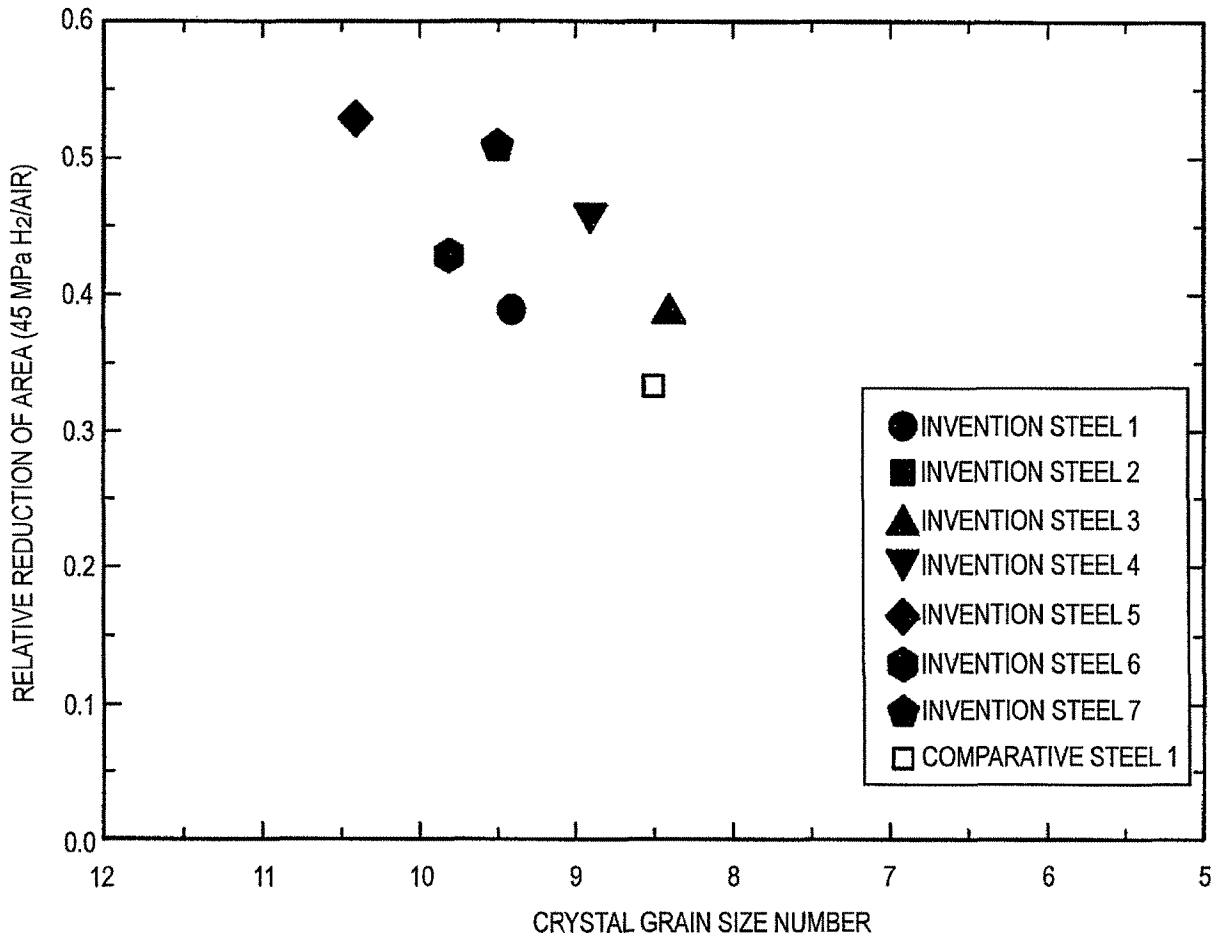
FIG. 3 is a graph showing relationship between a crystal grain size number and the relative reduction of area of invention steels and comparative steels in Examples.
Figure 4:
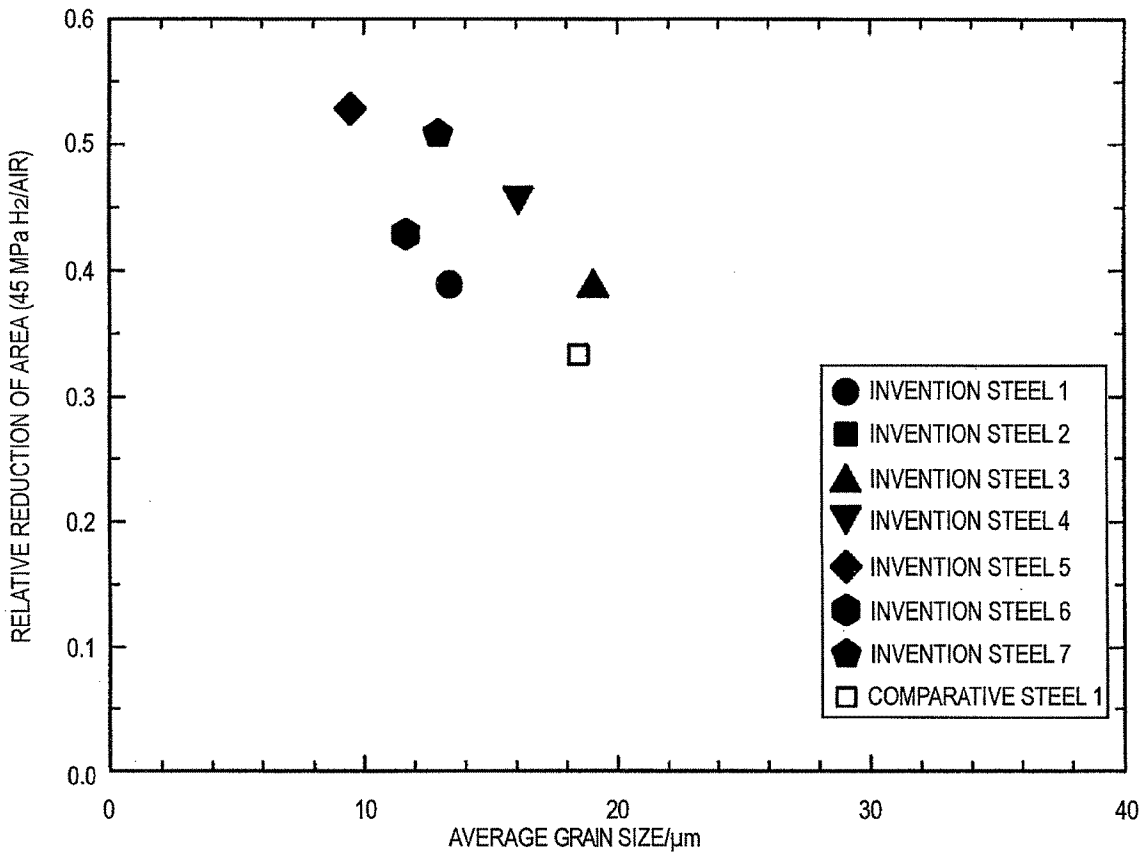
FIG. 4 is a graph showing relationship between an average grain size and the relative reduction of area of invention steels and comparative steels in Examples.

The relationship between the grain size number and the relative reduction of area of invention steels 1 to 7 and comparative steels 1 to 3 is shown in FIG. 3, and the relationship between the average grain size and the relative reduction of area of invention steels 1 to 7 and comparative steels 1 to 3 is shown in FIG. 4. The invention steels are approximately equivalent to or smaller than the comparative steel 1 in the grain size, and larger in the relative reduction of area. It is conceivable that the effect of grain refining due to the addition of Nb and Ti has been exerted.

Figure 5:
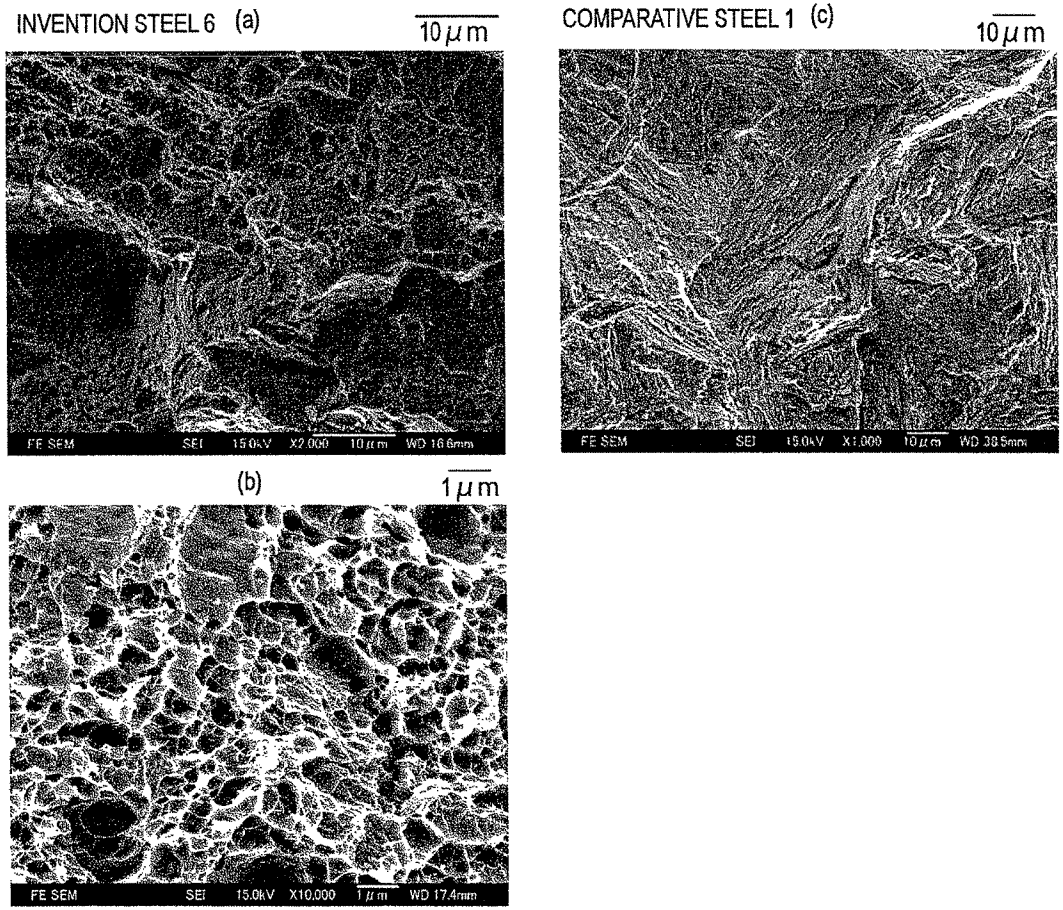
FIGS. 5(*a*) and 5(*b*) are views showing a fracture surface of a tensile test piece in hydrogen of 45 MPa of invention steel 6 in Examples, and FIG. 5(*c*) is a view showing a fracture surface of a tensile test piece in hydrogen of 45 MPa of comparative steel 1.

Views showing a fracture surface of a tensile test piece of invention steel 6 in hydrogen of 45 MPa, which has been observed under a scanning electron microscope (SEM), are shown in FIGS. 5(*a*) and 5(*b*). An observed view of a fracture surface of comparative steel 1 after the tensile test in hydrogen of 45 MPa is also shown in FIG. 5(*c*), for comparison. In comparative steel 1, a quasi-cleavage fracture surface is observed in the whole fracture surface. Compared with this, in invention steel 6, fine dimples having a diameter of 1 μm or less are observed. It is therefore conceivable that a ductile fracture behavior has occurred also under the hydrogen environment of 45 MPa.

The invention has been described based on the above-described embodiments and examples as described above. However, the invention is not intended to be limited to the description of the above-described embodiments and examples, and appropriate changes are of course possible without departing from the scope of the invention.

Although the invention has been described in detail with reference to specific embodiments, it will be apparent to those skilled in the art that various changes and modifications can be made without departing from the spirit and scope of the invention. The invention is based on Japanese Patent Application No. 2008-125838 filed on May 13, 2008, the contents of which are herein incorporated by reference.

INDUSTRIAL APPLICABILITY

According to the invention, as a main advantage thereof, it becomes possible to prepare a high-pressure hydrogen pressure vessel at a lower cost than an austenitic stainless steel, as described above. Further, the strength is higher than that of a conventional steel, and susceptibility to hydrogen environment embrittlement is small, so that the design pressure can be increased, or the design thickness can be thinned. Furthermore, as a subordinate advantage, the amount of hydrogen loaded can be increased by an increase in the design pressure. In addition, the production cost of the container can be deceased by a decrease in the thickness of the container.

What is claimed is:

1. A method for producing a high-strength low-alloy steel having high-pressure hydrogen environment embrittlement resistance characteristics, the method comprising:

melting an alloy steel material having a composition comprising C: 0.10 to 0.20% by mass, Si: 0.10 to 0.40% by mass, Mn: 0.50 to 1.20% by mass, Ni: 0.75 to 1.75% by mass, Cr: 0.20 to 0.80% by mass, Cu: 0.10 to 0.50% by mass, Mo: 0.10 to 1.00% by mass, V: 0.01 to 0.10% by mass, B: 0.0005 to 0.005% by mass and N: 0.01% by mass or less, and further comprising one or two of Nb: 0.01 to 0.10% by mass and Ti: 0.005 to 0.050% by mass, with the balance consisting of Fe and unavoidable impurities to form a steel ingot;

subjecting the steel ingot to hot-working to provide a hot-worked material;

after the hot-working, performing normalizing at 1,000° C. to 1,100° C. to homogenize a structure, wherein the normalizing is performed by heating the hot-worked material at 1,000° C. to 1,100° C. and then cooling;

after the normalizing, performing quenching from the temperature range of 880° C. to 900° C. to impart an optimum crystal grain size, wherein the quenching is performed by heating to 880° C. to 900° C. and then cooling; and after the quenching, performing tempering at 560° C. to 580° C. to impart an optimum tensile strength, wherein the tempering is performed by heating to 560° C. to 580° C.

2. A method for producing a high-strength low-alloy steel having high-pressure hydrogen environment embrittlement resistance characteristics according to claim 1, wherein the composition comprises C: 0.10 to 0.20% by mass, Si: 0.10 to 0.40% by mass, Mn: 0.50 to 1.20% by mass, Ni: 0.75 to 1.75% by mass, Cr: 0.20 to 0.80% by mass, Cu: 0.10 to 0.50% by mass, Mo: 0.10 to 1.00% by mass, V: 0.01 to 0.10% by mass, B: 0.0005 to 0.005% by mass and N: 0.01% by mass or less, and further comprises Nb: 0.01 to 0.10% by mass and Ti: 0.005 to 0.050% by mass, with the balance consisting of Fe and unavoidable impurities.

3. A method for producing a high-strength low-alloy steel having high-pressure hydrogen environment embrittlement resistance characteristics according to claim 1, wherein the composition comprises C: 0.10 to 0.20% by mass, Si: 0.10 to 0.40% by mass, Mn: 0. 50 to 1.20% by mass, Ni: 0.75 to 1.75% by mass, Cr: 0.20 to 0.80% by mass, Cu: 0.10 to 0.50% by mass, Mo: 0.10 to 1.00% by mass, V: 0.01 to 0.10% by mass, B: 0.0005 to 0.005% by mass and N: 0.01% by mass or less, and further comprises Ti: 0.005 to 0.050% by mass, with the balance consisting of Fe and unavoidable impurities.

4. A method for producing a high-strength low-alloy steel having high-pressure hydrogen environment embrittlement resistance characteristics according to claim 1, wherein the composition further comprises Ti: 0.012 to 0.032% by mass.

5. A method for producing a high-strength low-alloy steel having high-pressure hydrogen environment embrittlement resistance characteristics according to claim 1, wherein the composition further comprises Ti: 0.032 to 0.050% by mass.

6. A method for producing a high-strength low-alloy steel having high-pressure hydrogen environment embrittlement resistance characteristics, the method consisting of:

melting an alloy steel material having a composition comprising C: 0.10 to 0.20% by mass, Si: 0.10 to 0.40% by mass, Mn: 0.50 to 1.20% by mass, Ni: 0.75 to 1.75% by mass, Cr: 0.20 to 0.80% by mass, Cu: 0.10 to 0.50% by mass, Mo: 0.10 to 1.00% by mass, V: 0.01 to 0.10% by mass, B: 0.0005 to 0.005% by mass and N: 0.01% by mass or less, and further comprising one or two of Nb: 0.01 to 0.10% by mass and Ti: 0.005 to 0.050% by mass, with the balance consisting of Fe and unavoidable impurities to form a steel ingot;

subjecting the steel ingot to hot-working to provide a hot-worked material;

after the hot-working, performing normalizing at 1,000° C. to 1,100° C. to homogenize a structure, wherein the normalizing is performed by heating the hot-worked material at 1,000° C. to 1,100° C. and then cooling;

after the normalizing, performing quenching from the temperature range of 880° C. to 900° C. to impart an optimum crystal grain size, wherein the quenching is performed by heating to 880° C. to 900° C. and then cooling; and after the quenching, performing tempering at 560° C. to 580° C. to impart an optimum tensile strength, wherein the tempering is performed by heating to 560° C. to 580° C.

7. A method for producing a high-strength low-alloy steel having high-pressure hydrogen environment embrittlement resistance characteristics according to claim 6, wherein the composition comprises C: 0.10 to 0.20% by mass, Si: 0.10 to 0.40% by mass, Mn: 0.50 to 1.20% by mass, Ni: 0.75 to 1.75% by mass, Cr: 0.20 to 0.80% by mass, Cu: 0.10 to 0.50% by mass, Mo: 0.10 to 1.00% by mass, V: 0.01 to 0.10% by mass, B: 0.0005 to 0.005% by mass and N: 0.01% by mass or less, and further comprises Nb: 0.01 to 0.10% by mass and Ti: 0.005 to 0.050% by mass, with the balance consisting of Fe and unavoidable impurities.

8. A method for producing a high-strength low-alloy steel having high-pressure hydrogen environment embrittlement resistance characteristics according to claim 6, wherein the composition comprises C: 0.10 to 0.20% by mass, Si: 0.10 to 0.40% by mass, Mn: 0. 50 to 1.20% by mass, Ni: 0.75 to 1.75% by mass, Cr: 0.20 to 0.80% by mass, Cu: 0.10 to 0.50% by mass, Mo: 0.10 to 1.00% by mass, V: 0.01 to 0.10% by mass, B: 0.0005 to 0.005% by mass and N: 0.01% by mass or less, and further comprises Ti: 0.005 to 0.050% by mass, with the balance consisting of Fe and unavoidable impurities.

9. A method for producing a high-strength low-alloy steel having high-pressure hydrogen environment embrittlement resistance characteristics according to claim 6, wherein the composition further comprises Ti: 0.012 to 0.032% by mass.

10. A method for producing a high-strength low-alloy steel having high-pressure hydrogen environment embrittlement resistance characteristics according to claim 6, wherein the composition further comprises Ti: 0.032 to 0.050% by mass.

11. A method for producing a high-strength low-alloy steel having high-pressure hydrogen environment embrittlement resistance characteristics according to claim 1, wherein Al is not present in the composition of the alloy steel material.

12. A method for producing a high-strength low-alloy steel having high-pressure hydrogen environment embrittlement resistance characteristics according to claim 6, wherein Al is not present in the composition of the alloy steel material.

* * * * *